US008800426B2

(12) United States Patent
Andersson

(10) Patent No.: US 8,800,426 B2
(45) Date of Patent: Aug. 12, 2014

(54) HYDRAULIC LOAD CONTROL VALVE DEVICE

(75) Inventor: Bo Andersson, Jonkoping (SE)

(73) Assignee: Nordhydraulic AB, Kramfors (SE)

( * ) Notice: Subject to any disclaimer, the term of this patent is extended or adjusted under 35 U.S.C. 154(b) by 1183 days.

(21) Appl. No.: 12/599,602

(22) PCT Filed: May 12, 2008

(86) PCT No.: PCT/SE2008/050549

§ 371 (c)(1),
(2), (4) Date: Nov. 10, 2009

(87) PCT Pub. No.: WO2009/020421

PCT Pub. Date: Feb. 12, 2009

(65) Prior Publication Data

US 2010/0242719 A1 Sep. 30, 2010

(30) Foreign Application Priority Data

May 11, 2007 (SE) ..... 0701142-2

(51) Int. Cl.
*F15B 11/024* (2006.01)

(52) U.S. Cl.
USPC ..... 91/420; 91/436; 91/445

(58) Field of Classification Search
CPC ..... F15B 11/003; F15B 11/024
USPC ..... 91/420, 421, 436, 445, 447
See application file for complete search history.

(56) References Cited

U.S. PATENT DOCUMENTS

| | | | | |
|---|---|---|---|---|
| 4,531,449 | A | 7/1985 | Reith | |
| 4,610,193 | A * | 9/1986 | Barker et al. | 91/420 |
| 4,972,761 | A * | 11/1990 | Thomsen | 91/420 |
| 5,191,826 | A | 3/1993 | Brunner | |
| 5,211,196 | A | 5/1993 | Schwelm | |
| 5,259,293 | A | 11/1993 | Brunner | |
| 5,415,076 | A * | 5/1995 | Krone et al. | 91/421 |
| 2006/0075750 | A1 | 4/2006 | Evans | |

FOREIGN PATENT DOCUMENTS

| | | |
|---|---|---|
| DE | 32 16 580 | 2/1983 |
| DE | 3237103 | 4/1984 |

* cited by examiner

*Primary Examiner* — F. Daniel Lopez
(74) *Attorney, Agent, or Firm* — Young & Thompson

(57) ABSTRACT

A hydraulic load control valve (10) accommodated between a hand valve (H) and a hydraulic engine (D) has got at least one proportional load control valve (E), controlled by the pump pressure independent of the flow of hydraulic fluid to the engine. The flow to the engine (D) flows via a non-return valve (12), that is prestressed to open at a pump pressure above the upper limit before a given pressure interval, within which the load control valve (E) is adjusted between completely closed and completely open position of the pump pressure.

15 Claims, 4 Drawing Sheets

HYDRAULIC LOAD CONTROL VALVE DEVICE

BACKGROUND

The invention relates to a hydraulic load control valve device and is described by way of examples with particular reference to its application on hydraulically driven and manoeuvred lifting cranes, especially vehicular lifting cranes.

These lifting cranes commonly have a crane boom that may oscillate up and down by a double acting hydraulic lift cylinder that acts between the crane boom and the framework or the support of the crane. This lift cylinder is part of a hydraulic system that comprises a hydraulic pump and a hand valve, by which the pump may be selectively connected with the one lift cylinder chamber when the crane boom is about to be raised and with the second lift cylinder chamber when the crane boom is about to be lowered. Simultaneously, in the first case the second lift cylinder chamber, and in the second case the first cylinder chamber is, via the hand valve, connected to the tank for the hydraulic fluid.

Normally the crane boom strives to move down by means of its own weight and the weight of a possible load that is suspended from the crane boom. For security reasons the hydraulic system is constructed such that it is not possible to lower the load if the hydraulic pump is not connected to the second lift cylinder chamber and via a connection controls a load control valve to open a connection from the first lift cylinder chamber to the tank. If there is no such securing arrangement a broken line between the first lift cylinder chamber and the hand valve could result in that the crane boom and a possible load suspended therein fall freely. Parallel to the load control valve lies a non-return valve that opens towards the first lift cylinder chamber, so it is possible to let the hydraulic fluid pass from the pump to this lift cylinder chamber. This type of security devices is particularly common in hydraulic systems where the crane operator may control the hand valve of the lift cylinder directly mechanically, e.g. by means of an operating handle.

An unsatisfactory problem of a securing arrangement of the described type and other conventional securing arrangements of similar type is that the efficiency of the hydraulic system gets low and results in that the system has a tendency to oscillate when lowering of a load.

OBJECT OF THE INVENTION

The object of the present invention is to find a solution to these problems and on one hand provide a load control valve device that saves a considerable part of the energy that gets lost when lowering a load with conventional hydraulic load control valve devices of the type described above, on the other hand provide a load control valve device that better than conventional load control valve devices are able to lower a load without creating oscillations in the load carrying system.

The invention is described in detail below, with reference to the accompanying drawings.

SHORT DESCRIPTION OF THE DRAWINGS

DETAILED DESCRIPTION OF THE FIGURES

Figure 1:
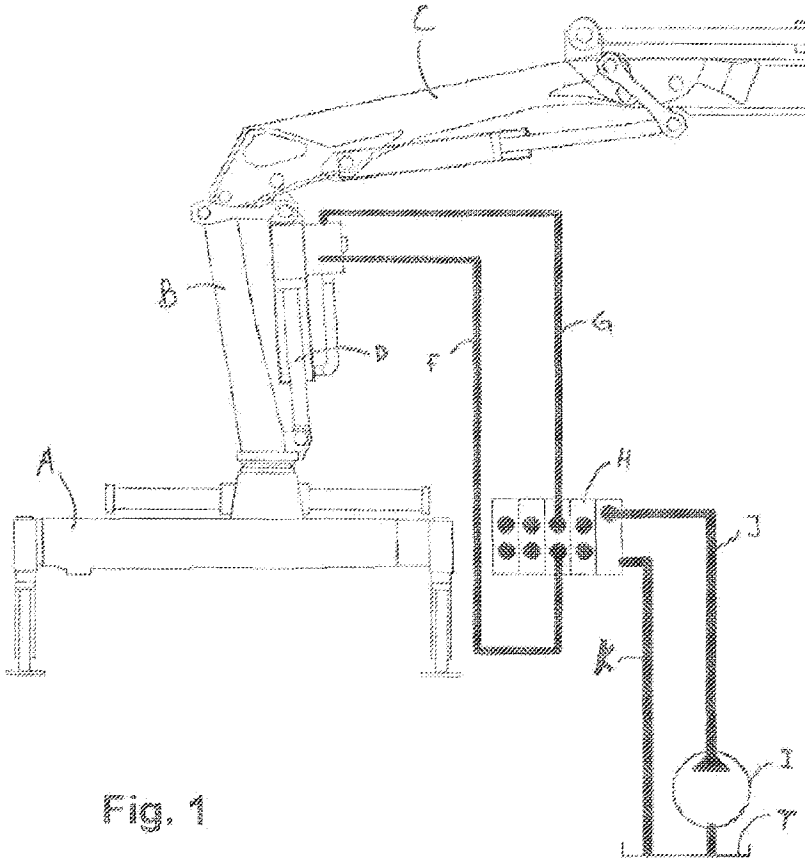
Fig. 1 Prior Art
FIG. 1 shows a vehicle with a hydraulically manoeuvred boom and a hydraulic system with a double acting hydraulic lift cylinder and a conventional valve device mounted thereon.

The hydraulically manoeuvred lifting boom shown in FIG. 1 is adapted to be arranged on a vehicle (not shown) and has a base A with a rotatable crane B, which carries the boom arm C at its upper end. A double acting hydraulic engine, in form of a hydraulic lift cylinder D is arranged between the boom arm C and the foot of the crane B of the base. Lines F and G connect the two lift cylinder chambers to a hand valve H, which in the shown example is lever controlled and in turn is connected to a hydraulic pump and a tank T via additional lines J and K, respectively.

Figure 2:
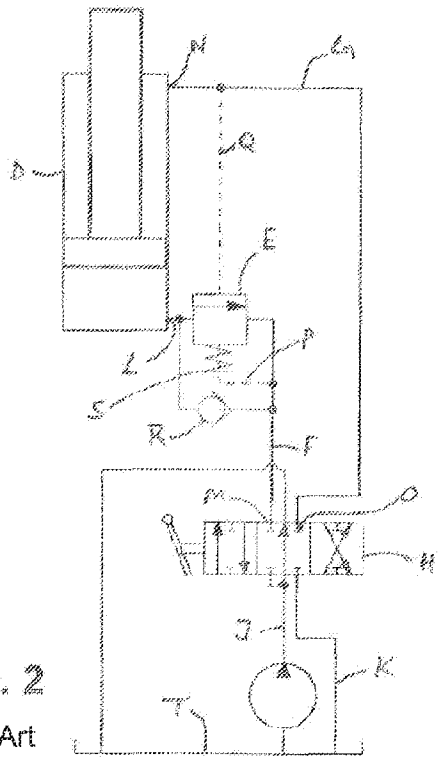
Fig. 2 Prior Art
FIG. 2 is a hydraulic diagram for the lift cylinder in FIG. 1, provided with a conventional load control valve device, and the adherent part of the hydraulic system of the boom.

In FIG. 2, a part of the hydraulic system of the machine, which is useful to manoeuvre the lift cylinder D, is shown. The first, lower, chamber of the lift cylinder (the lifting chamber), has a first engine port, hereafter called the lower lift cylinder port L, as the lift cylinder D constitutes the engine. The line F connects the lift cylinder port to a first operational port M on the hand valve H, which in the shown example is of an open centre type. The second, upper chamber of the lift cylinder (the release chamber) correspondingly has a second engine port, called upper lift cylinder port N, which is connected to a second operational port O on the hand valve H, via the line G. In the line F the normally closed, proportional load control valve is accommodated.

Load control valve E has one inlet port that communicates with the lower lift cylinder port L, and one outlet port that communicates with the first operational port M on the hand valve H, one first control inlet that also, via a control line P, communicates with the first operational port M, and a second control inlet that communicates with the upper lift cylinder port N via a control line Q. In conjunction to the load control valve E, a non-return valve R is arranged, which is connected to the lower lift cylinder port L and the first operational port M on the hand valve H and opens towards the lift cylinder port L. The load control valve E is permanently loaded towards a closed position by means of a spring S.

When the boom C on the crane in FIGS. 1 and 2 stands still with the hand valve H in the shown neutral, the pump I pumps the hydraulic fluid under very low pressure through the line J and the hand valve H, directly back to the tank T.

When raising of the boom C (raising of a positive load) the hand valve H leads the hydraulic fluid under high pressure from the pump I through the first operational port M and the non-return valve R to the lower chamber of the lift cylinder D. The hydraulic fluid at the same time flows under low pressure through the line G and the hand valve H to the tank T.

At lowering of the boom C (lowering of a positive load) the hydraulic fluid is led from the pump I through the second operational port O on the hand valve H to the upper chamber in the lift cylinder D. The hydraulic fluid at the same time via control line Q acts on the upper side of the load control valve E and presses it towards open position contrary to the action of the spring S. As the pump pressure has to work against the action of the spring S to be able to open the load control valve E, the pump pressure will be set to a relatively high level, and part of the pump flow will return to fill up the upper chamber of the lift cylinder D. The whole pump flow will also have a high pressure with a great loss of power as a result.

Another disadvantage of the known system in FIGS. 1 and 2 is that it tends to oscillate at load lowering, depending on that the pressure in the upper lift cylinder chamber varies heavily in dependence of the velocity at which the plunger moves in the lift cylinder D.

The load control valve device according to the invention represents a considerable improvement regarding loss of power and tendency to oscillate compared to the known art as it is evident from FIGS. 1 and 2. Five exemplifying embodiments of the invention are shown in FIGS. 3-7. These figures differs schematically from FIG. 2 only regarding the design of the load control valve device, and for remaining parts in FIGS. 3-7 the same references and designations as in FIG. 2 are thus used for same or corresponding elements. The same applies for elements in the load control valve device in FIGS. 3-7 that corresponds to elements in the load control valve E in FIGS. 1 and 2, with a few exceptions.

The load control valve device is in the figures generally denoted with 10. It corresponds partly to the load control valve E in FIGS. 1, 2 and has for example like this one a proportional load holding valve, but it is complemented with a number of additional non-return valves. In addition to a non-return valve 11 and the spring S, which corresponds to the non-return valve T and the spring S in FIG. 2, respectively, it has two other non-return valves 12 and 15.

Together with these non-return valves 12 and 15, the load control valve E including the non-return valve 11 constitutes the load control valve device 10. This load control valve device 10 is in FIGS. 3, 4 and 5 enclosed by a broken line and may form a valve unit that may be mounted on the lift cylinder D. To the load control valve device 10 tubes or pipes may be connected to conduct hydraulic fluid to and from the lift cylinder D, via the hand valve H. The places on the load control valve device 10 where this may be connected to the lift cylinder D, i.e. connected to the lift cylinder D, i.e. the upper and lower lift cylinder port L and N, are denoted L' and N', respectively, and thus constitute a first and second engine connecting port, respectively. The places where the load control valve device 10 may be connected to the operational ports M and O on the hand valve H, are here denominated first valve connecting port and second valve connecting port, respectively, and are denoted M' and O', respectively.

The non-return valve 12, that is accommodated in the line G and connects the upper cylinder connecting port N' to the second valve connecting port O', and therefrom via the second operational port O on the hand valve H, opens towards the cylinder connecting port N' and is loaded, prestressed, towards a closed position by means of a spring 16 to open only at a chosen intensified inlet pressure, which is relatively low, for example 10-15% of the highest pump pressure. In an exemplifying case, the opening pressure of the non-return valve 12 is approximately 30 bar.

The non-return valve 15, which is also not prestressed, is connected anti-parallel with respect to the non-return valve 12 to admit discharge from the upper lift cylinder chamber in the lift cylinder D to the second operational chamber O in the hand valve H via the upper cylinder connecting port N'.

One control line 18, which corresponds to the control line Q in FIG. 2, connects the control inlet on the load control valve E to the line G on the inlet side of the non-return valve 12.

The load control valve E is arranged to open at the lower limit of a specific pressure interval and is proportional from a totally closed to a fully open position when the control pressure in the control line 18 rises from the lower limit to the upper limit of the pressure interval. The upper limit of the pressure interval is at least slightly below the pressure at which the prestressed non-return valve 12 opens. In the example the pressure interval is 10-25 bar, which accordingly is a bit lower than the pressure needed to open the prestressed non-return valve 12. Thus, the pump flow to the lift cylinder D, which in the system in FIGS. 1 and 2 with the known load control valve is caused as a consequence of that the pressure in the line G varies with the velocity of the plunger in the lift cylinder D, is eliminated, whereby the cylinders non desired tendency to oscillate is eliminated.

Figure 4:
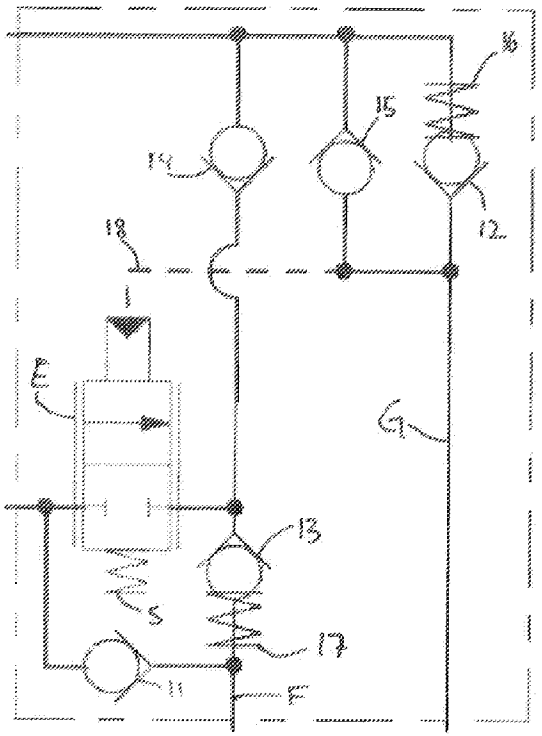
FIG. 4 is a hydraulic diagram resembling the one in FIG. 3, but showing a load control valve device complemented with a device for regeneration of hydraulic fluid.
Figure 3:
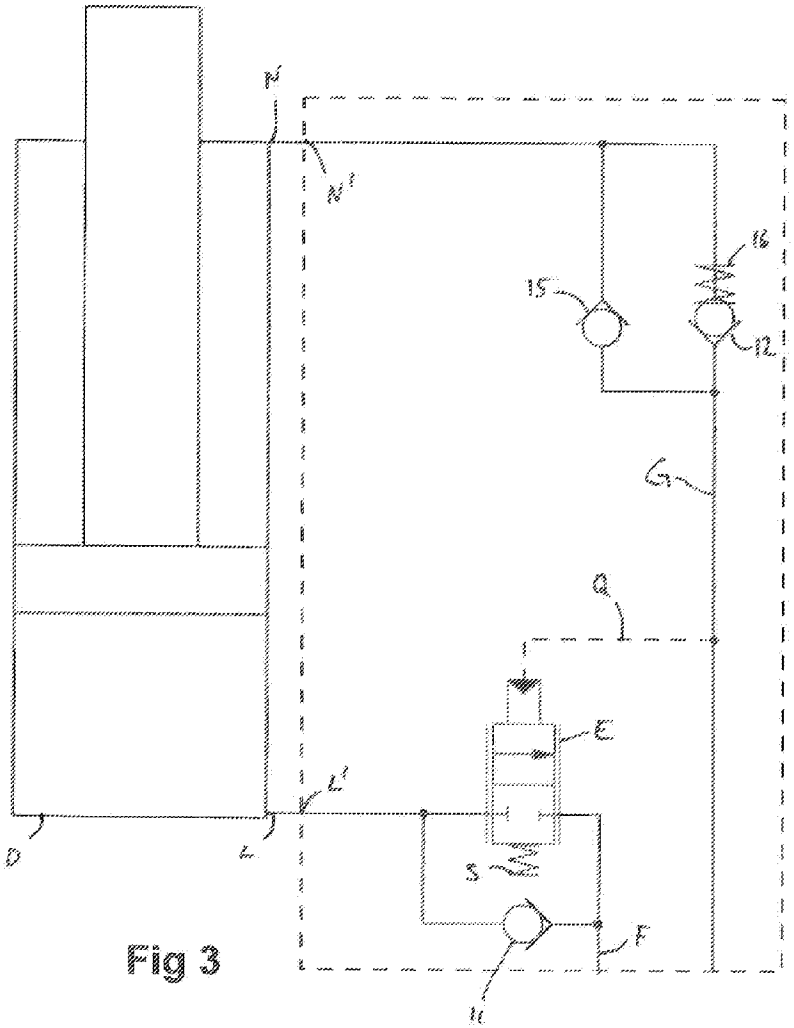
FIG. 3 is a hydraulic diagram resembling the one in FIG. 2, but showing a load control valve device in accordance with a first embodiment of the invention.
Figure 5:
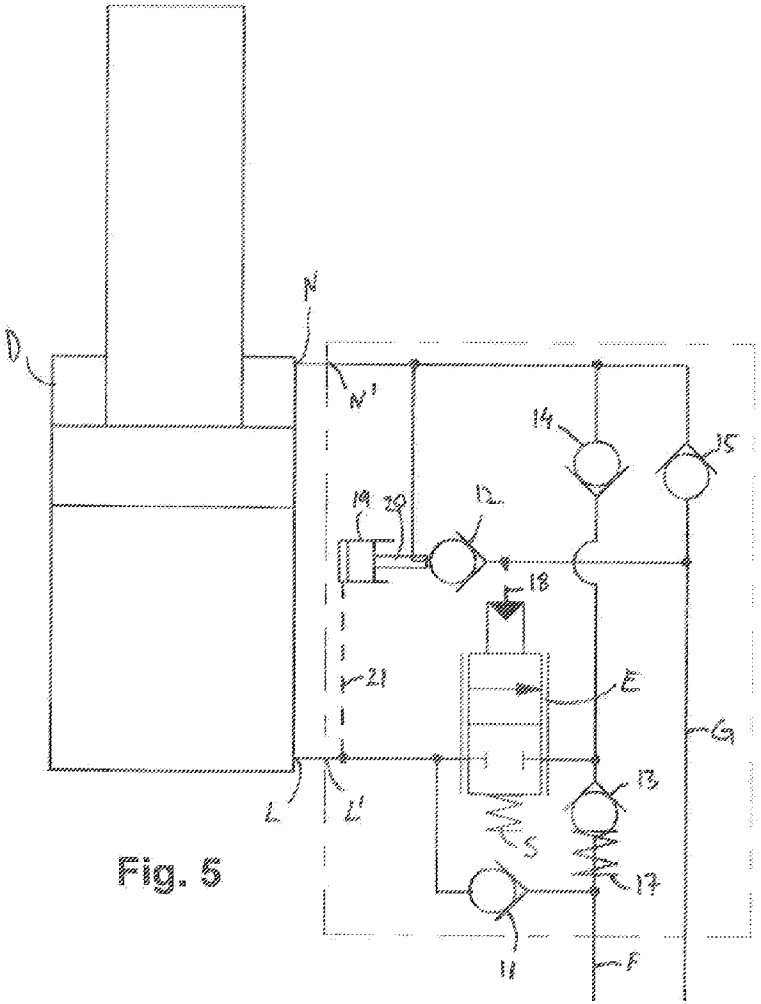
FIG. 5 is a hydraulic diagram resembling the one in FIG. 4, but showing a load control valve device in accordance with a further embodiment of the invention.

In FIGS. 4 and 5 two further advantageous embodiments of the invention are shown, which provides further developments of the embodiment in FIG. 3 according to the invention. In these there are two further non-return valves arranged, which are arranged to accomplish a regeneration of hydraulic fluid from the lower lift cylinder port L to the upper lift cylinder port N, at a load lowering. The advantage of such a regeneration is above all that the pump does not have to operate at load lowering, but also that the load lowering may be accomplished totally without oscillations.

The non-return valve 13 is connected in the line F between the outlet of the load control valve E and the first valve connecting port M'. It is prestressed towards closed position with a spring 17 to open at first at an increased but compared to the opening pressure of the non-return valve 12 low pressure, which in the chosen example case is 3 bar.

The non-return valve 14, which is not prestressed, is arranged between the outlet of the load control valve E and the upper cylinder connecting port N'. As it is not prestressed towards closed position, it is more easily opened than the non-return valve 13. It is however not completely necessary that the non-return valve 13 is prestressed to accomplish the desired result. The lines from the load control valve E via the hand valve H includes in itself a certain resistance that has the same effect as a prestressed valve, whereby the hydraulic fluid still will choose the way with minimum resistance, which at load lowering thus is through the non-return valve 14 to the upper lift cylinder port N, where the pressure then is close to zero.

The hand valve H is so arranged, that the operator by setting the operation valve in load lowering position, i.e. by means of the operating handle connect the line G to the pump I and connect the line F to the tank T, may vary the pressure in the line G, and thereby the pressure on the control inlet of the load control valve E within the chosen pressure interval. As the non-return valve 12 then will not reach its opening pressure, and as the non-return valve 15 remains closed, no flow of hydraulic fluid will flow from the pump I through the line G to the upper lift cylinder port N, but the pump pressure only serves as control signal for the load control valve E.

Consequently, no pump power for the lowering of the load is consumed; the pump power that is consumed is limited to the relatively low power that is needed to maintain the control signal for the load control valve E to keep it open.

At the load lowering the plunger in the lift cylinder D presses, under influence of the load, a flow of hydraulic fluid out of the lower lift cylinder port L and the lower cylinder connecting port L' and through the load control valve E. This flow goes primarily through the practically pressureless opened non-return valve 14 to the upper lift cylinder chamber, so that it is continuously filled to the same degree as the volume is increased. As the outgoing flow from the lower lift cylinder chamber is greater than the flow that the upper lift cylinder chamber may receive, a certain flow also goes through the non-return valve 13 and the hand valve H to the tank T.

At load raising, the hand valve H is positioned in the position in which it connects the first operating port M on the hand valve H, and the pump I with the line F and, via the non-return valve 11 and the lower valve connecting port L', to the lower lift cylinder port L, such that the lower lift cylinder chamber may be filled with hydraulic fluid with the pressure that is needed for the load raising. The hydraulic fluid that is then pushed out of the upper lift cylinder chamber through the upper lift cylinder port N and the upper valve connecting port N' goes via the easily opened non-return valve 15 and the line G to the second valve connecting port O' and operating port O and further to the tank T. The load raising thus takes place in essentially the same way as with the known load control valve E in FIGS. 1 and 2.

FIG. 5, in which the hand valve H, the pump I, the tank T and the lines J and K that connects the hand valve with the pump and the tank are omitted, but are the same as in FIG. 4, shows another embodiment which is appropriate to use in cases where it is often desired to press down the plunger of the lift cylinder D, for example to press down the boom arm or a tool in it in the ground or against other support. In such cases the pressure drop, for example 30 bar as in the above mentioned example, over the prestressed non-return valve 12 may be troublesome for energy consuming reasons. To eliminate this inconvenience the non-return valve 12 lacks the prestressed spring shown in FIG. 3. It is instead provided with a hydraulic prestressed device 19, which automatically becomes inactive when the pressure disappears, for example when the lift cylinder port L is removed.

The prestressed device 19 consist of a single acting cylinder, which rod plunger 20 acts on the non-return valve 12 in the closing direction. The cylinder chamber of the adjusting chamber is connected to the lower cylinder connecting port L" and the lower cylinder port L through a control line 21. The cylinder chamber of the cylinder will accordingly be pressureless or practically pressureless when the upper lift cylinder chamber is pressurised and the load control valve E therefore is open. By that the pump flow may flow via the non-return valve 12 to the upper lift cylinder chamber without any essential pressure drop.

Figure 6:
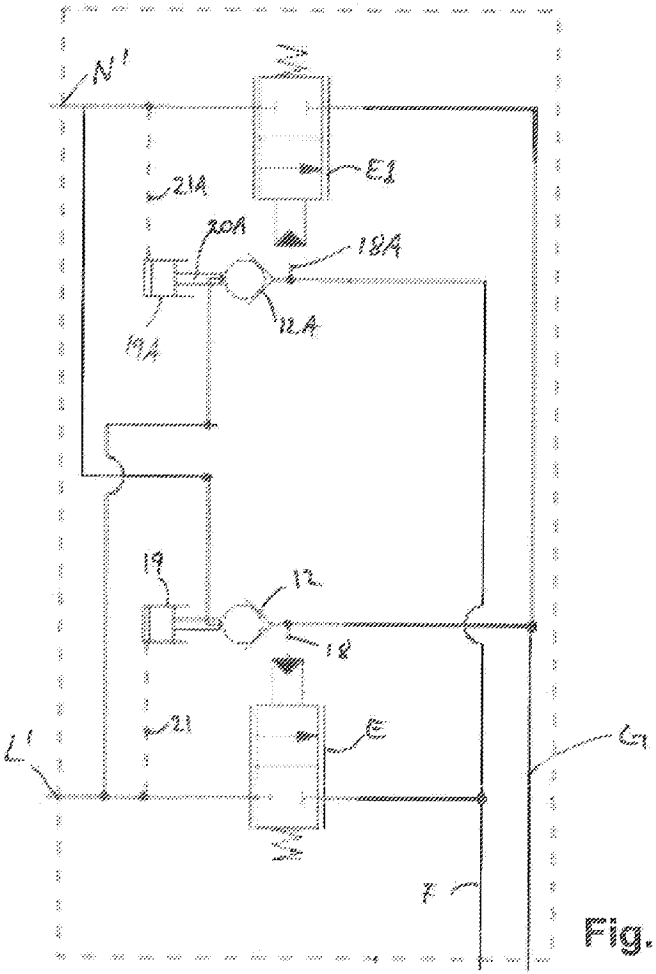
FIG. 6 is a hydraulic diagram resembling the one in FIG. 3, but showing a load control valve device with a load control device for each lift cylinder chamber.

The embodiment in FIG. 6 differs from the embodiment in FIG. 3 by having two load control valves E, E1, which belongs to each one of the cylinder chambers in the lift cylinder D. The load control valve E has got the same function as the load control valve E in FIGS. 3, 4 and 5, i.e. it protects against uncontrolled movement from the lift cylinder plunger towards the bottom end of the cylinder (downwards). The load control valve E1 has got the corresponding function for the plunger motion towards the plunger rod end of the lift cylinder (upwards). The function of the load control valve E1 is needed in situations when the load strives to twist the lift cylinder plunger towards the plunger rod end, for example when a load changes from being a lift load (positive load) to a lowering load (negative load).

The load control valve E1 has in the diagram in FIG. 6 replaced the non-return valve 15 from FIGS. 3, 4 and 5. Additionaly, the non-return valve 11 from the same figure has been replaced by a prestressed non-return valve 12A, which is arranged to act in the same way as the non-return valve 12. With the diagram shown in FIG. 6 the undesired tendency of the cylinder to oscillate when the cylinder is moved towards the load, is thus eliminated.

Figure 7:
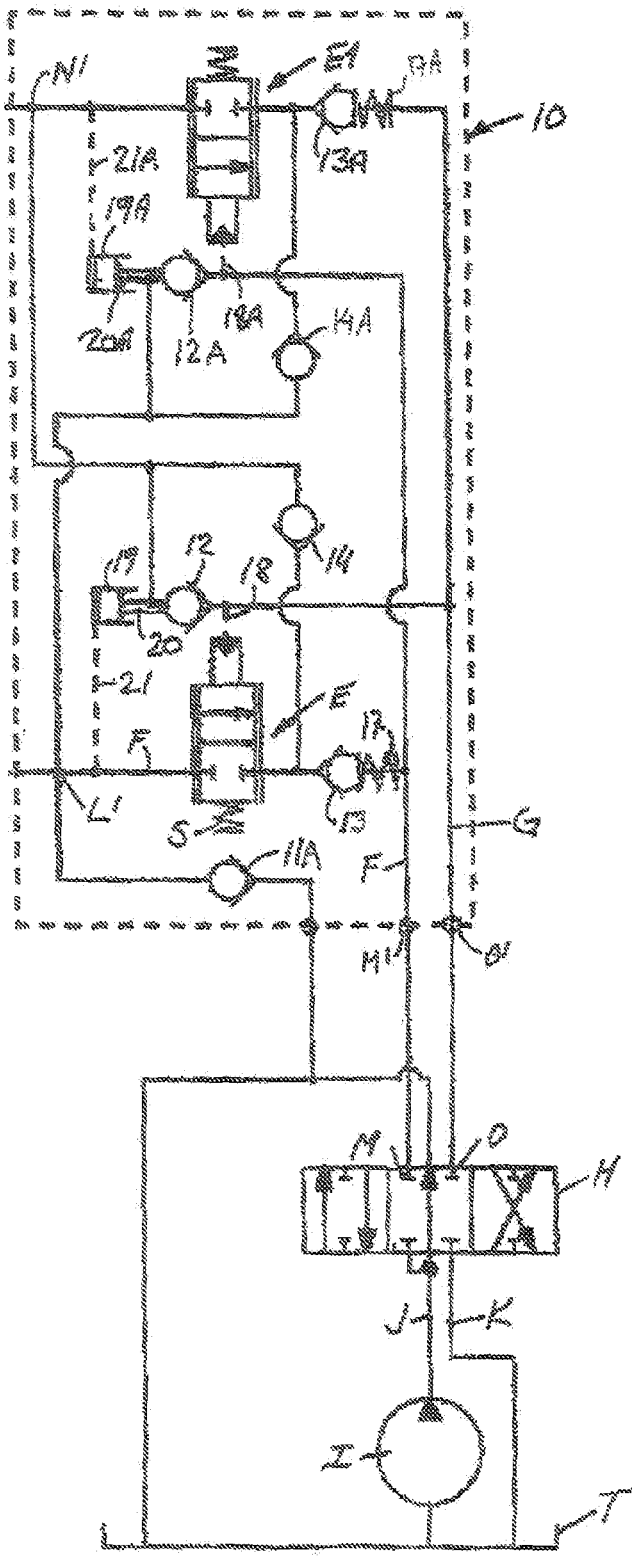
FIG. 7 is a hydraulic diagram resembling the one in FIG. 6, but showing a load control valve device complemented with devices for regeneration of hydraulic fluid.

In the same way as FIG. 5 differs from FIG. 3, the diagram in FIG. 7 differs from the diagram in FIG. 6. I.e. in figure the double load holding valve is complemented with double devices for regeneration of hydraulic fluid.

The non-return valves 12, 13 and 14 are arranged in essentially the same way as in FIG. 5. A non-return valve 11A is arranged and has its inlet connected to the tank T. The prestressed non-return valve 12A, which serves the upper cylinder chamber of the lift cylinder D, of course has its inlet connected to the first valve connecting port M'. The non-return valve 14A has got its outlet connected to the lower cylinder connecting port L' and accordingly also to the outlet on the non-return valve 11A.

The load control device E1 is arranged in the same way as the load control valve E, except for that it serves the upper lift cylinder chamber. The inlet port of the load control valve E1 communicates accordingly with the upper valve connecting port N' and the upper lift cylinder port N, and the outlet port communicates with the inlet on the slightly prestressed non-return valve 13A and the inlet of the easily opened non-return valve 14A. The outlet on the non-return valve 13A is of course connected to the line G and O'. The outlet of the non-return valve 14A is connected to the lower cylinder connecting port L' and accordingly also to the control line 21 for the prestressed device 19.

The load control valve E1 also has a non-return valve 12A with a hydraulic prestressed device 19A, that resembles the prestressed device 19A and includes a single acting cylinder 20A, which plunger rod acts on the non-return valve in the closing direction via a control line 21A, which is connected to the upper cylinder connecting port N' and the upper lift cylinder port N.

If the load on the lift cylinder plunger is positive and accordingly strives to press the lift cylinder plunger towards the bottom end of the lift cylinder, the non-return valve 12 is loaded in the closing direction from the pressure in the lower lift cylinder chamber. If the hand valve H is in neutral, the non-return valve 12 is firmly closed from the pressure of the load. Closed is also the load control valve E.

If the hand valve H is put in position for raising of the positive load, the pressure in the control line 18A will open the load control valve E1, such that this load control valve opens a discharging way from the upper lift cylinder chamber to the slightly prestressed non-return valve 13A, to the hand valve H and via the hand valve to the tank T. The non-return valve 14A is held firmly closed by the high pressure in the lower lift cylinder chamber. The upper lift cylinder chamber is pressureless, which means that the non-return valve 12A lacks prestressing and may be opened without causing any greater loss of pressure of the hydraulic fluid on its way from the pump I to the lower lift cylinder chamber.

If the positive load instead is to be lowered, the hand valve H is set in the position in which it connects the pump I with the line G. The load control valve E is then opened by the pressure in the control line 18, such that hydraulic fluid under a large pressure drop may be discharged in a controlled way from the lower lift cylinder chamber partly via the easily opened non-return valve 14 to the upper cylinder chamber such that it is refilled and cavitations in it is prevented, and partly via the slightly prestressed non-return valve 13 to the tank T.

If the load on the other hand is negative or changes from being positive to being negative, such that it strives to press the plunger in the lift cylinder D towards its plunger rod end and by means of that holds the upper lift cylinder chamber under high pressure, while the lower lift cylinder chamber is pressureless, the high pressure in the upper lift cylinder chamber prevents through its action on the prestressed device 19A that the non-return valve opens. If the plunger in the lift cylinder then is to be displaced towards the acting direction of the load, i.e. towards the plunger rod end (uppwards), the hand valve H is set in that position in which it connects the pump I with the line F. The pressure of the pump acts through the control line 18A on the load control valve E1 such that it opens and discharges the hydraulic fluid from the upper lift cylinder chamber under a large pressure drop.

The discharged hydraulic fluid flows firstly via the easily opened non-return valve 14A to the lower lift cylinder chamber to fill it together with additional hydraulic fluid taken from the tank T via the non-return valve 11A, such that cavitation in it, the lower lift cylinder chamber, is prevented. Removal of the load thus takes place in a controlled way with help from the load control valve E1 and without needing to add any power worth mentioning from the pump I. To make this work the hand valve thus should be of the open-centre type, as the one shown in the figure, as the fluid that passes the non-return valve 11A is intended to be distributed through the centre opening.

In the same way as the load control device in FIG. 4 and for the same reasons that have been stated in conjunction with the description of it, the load control valve devices 10 in FIGS. 5 and 7 also operate very economically and without, or practically without, oscillation tendencies.

Worth mentioning is that in spite that the load control device in FIG. 7 has a, in comparison with the load control valve devices in FIGS. 4 and 5, doubled load control function, the number of non-return valves in it is not doubled. Compared to the known load control valve E in FIGS. 1 and 2 the load control valve devices 10 in FIGS. 4 and 5 have got four more non-return valves. In spite of the doubled load control function, the load control valve device in FIG. 7 only has got two non-return valves more than the load control valve device in FIGS. 4 and 5.

The invention claimed is:

1. A hydraulic load control valve device, comprising:

a first engine connecting port (L') and a second engine connecting port (N') that are arranged to be connected to a first engine port (L) and a second engine port (N), respectively, on a double acting hydraulic cylinder (D);

a first valve connecting port (M') and a second valve connecting port (O'), which are arranged to be connected to separate operational ports (M and O, respectively) on a hand valve (H);

a normally closed proportional load control valve (E), which has an inlet connected to the first engine connecting port (L') and an outlet connected to the first valve connecting port (M') and a control inlet that is hydraulically connected to the second valve connecting port (O'), said load control valve (E) arranged to vary between a closed position and a fully opened position as a pressure on the control inlet varies over a predetermined pressure interval; and a first check valve (12), an outlet side of said first check valve (12) connected to the second engine connecting port (N') and an inlet side of said first check valve (12) connected to the second valve connecting port (O'), said first check valve (12) being pre-stressed or pre-stressable to open only when a pressure on the inlet side is higher than the predetermined pressure interval.

2. The load control valve device according to claim 1, wherein an opening pressure of the first check valve (12) is controllable by means of a pressure in the first engine connecting port (L').

3. The load control valve device according to claim 2, further comprising:

a second, mainly pressureless opening check valve (14), an inlet of said second check valve (14) connected to the outlet of the load control valve (E) and an outlet of said second check valve (14) connected to the second engine connecting port (N').

4. The load control valve device according to claim 1, further comprising:

a second, mainly pressureless opening check valve (14), an inlet of said second check valve (14) connected to the outlet of the load control valve (E) and an outlet of said second check valve (14) connected to the second engine connecting port (N').

5. The load control valve device according to claim 1, further comprising:

a third, slightly prestressed check valve (13), an inlet of said third check valve (13) connected to the outlet of the load control valve (E) and an outlet of said third check valve (13) connected to the first valve connecting port (M').

6. The load control valve device according to claim 1, further comprising:

a fourth check valve (15) connected anti-parallel with respect to the first check valve (12), an inlet side of said fourth check valve (15) connected to the second engine connecting port (N') and an outlet side of said fourth check valve (15) connected to the second valve connecting port (O')

7. The load control valve device according to claim 1, further comprising:

a fifth check valve (11) connected anti-parallel with respect to the load control valve (E), an outlet of said fifth check valve (11) connected to the first engine connecting port (L') and an inlet of said fifth check valve (11) connected to the first valve connecting port (M').

8. The load control valve device according to claim 1, further comprising:

a seventh check valve (11A), an inlet side of said seventh check valve (11A) connected to a tank (T) and an outlet side of said seventh check valve (11A) connected to the second engine connecting port (N').

9. The load control valve device according to claim 1, further comprising:

an additional, normally closed, proportional load control valve (E1), which is similar to the first mentioned load control valve (E), an inlet of said additional proportional load control valve (E1) connected to the second engine connecting port (N'), an outlet of said additional proportional load control valve (E1) connected to the second valve connecting port (O') and a control inlet that is hydraulically connected to the first valve connecting port (M'), and which is arranged to vary between a closed position and a fully opened position as the pressure on the control inlet varies over the predetermined pressure interval; and an additional check valve (12A), an outlet side of said additional check valve (12A) connected to the first engine connecting port (L') and an inlet side of said additional check valve (12A) connected to the first valve connecting port (M'), said additional check valve (12A) being prestressed or prestressable to open only when a pressure on the inlet side of said additional check valve (12A) is higher than the predetermined pressure interval.

10. The load control valve device according to claim 9, wherein an additional opening pressure of the additional check valve (12A) is controllable by means of a pressure in the second engine connecting port (N').

11. The load control valve device according to claim 10, further comprising:

a sixth, mainly pressureless opening check valve (14A), an inlet of the sixth check valve (14A) connected to the outlet of the additional proportional load control valve (E1) and an outlet of the sixth check valve (14A) connected to the first engine connecting port (L').

12. The load control valve device according to claim 10, further comprising:

a sixth check valve (13A), which is similar to the third check valve (13) and an inlet side of the sixth check valve (13A) connected to the outlet of the additional proportional load control valve (E1) and which connects the outlet of the additional proportional load control valve (E1) with the second valve connecting port (O') and is prestressed to open only at a somewhat intensified outlet pressure.

13. The load control valve device according to claim 9, further comprising:

a sixth, mainly pressureless opening check valve (14A), an inlet of the sixth check valve (14A) connected to the outlet of the additional proportional load control valve (E1) and an outlet of the sixth check valve (14A) connected to the first engine connecting port (L').

14. The load control valve device according to claim 13, further comprising:

a seventh check valve (13A), which is similar to the third check valve (13) and an inlet side of the sixth check valve (13A) connected to the outlet of the additional proportional load control valve (E1) and which connects the outlet of the additional proportional load control valve (E1) with the second valve connecting port (O') and is prestressed to open only at a somewhat intensified outlet pressure.

15. The load control valve device according to claim 9, further comprising:

a sixth check valve (13A), which is similar to the third check valve (13) and an inlet side of the sixth check valve (13A) connected to the outlet of the additional proportional load control valve (E1) and which connects the outlet of the additional proportional load control valve (E1) with the second valve connecting port (O') and is prestressed to open only at a somewhat intensified outlet pressure.

* * * * *